US009674916B2

(12) United States Patent
Hashimoto

(10) Patent No.: US 9,674,916 B2
(45) Date of Patent: Jun. 6, 2017

(54) LIGHTING CONTROL DEVICE, LIGHTING APPARATUS AND LUMINAIRE

(71) Applicant: Panasonic Intellectual Property Management Co., Ltd., Osaka-shi, Osaka (JP)

(72) Inventor: Tomomi Hashimoto, Kyoto (JP)

(73) Assignee: PANASONIC INTELLECTUAL PROPERTY MANAGMENT CO., LTD., Osaka (JP)

( * ) Notice: Subject to any disclaimer, the term of this patent is extended or adjusted under 35 U.S.C. 154(b) by 0 days.

(21) Appl. No.: 15/208,261

(22) Filed: Jul. 12, 2016

(65) Prior Publication Data

US 2017/0019971 A1 Jan. 19, 2017

(30) Foreign Application Priority Data

Jul. 13, 2015 (JP) ..... 2015-139401

(51) Int. Cl.
*H05B 37/02* (2006.01)
*H05B 33/08* (2006.01)

(52) U.S. Cl.
CPC ..... *H05B 33/0854* (2013.01); *H05B 33/0809* (2013.01); *H05B 33/0851* (2013.01); *H05B 33/0866* (2013.01); *H05B 37/0272* (2013.01)

(58) Field of Classification Search
CPC ..... H05B 33/0815; H05B 33/0851; H05B 33/0809; H05B 33/0896; H05B 33/0842; H05B 37/02; H05B 33/0854; H05B 37/0272; H05B 37/0218; H05B 33/0866; Y02B 20/346; Y02B 20/48; F21V 23/06
See application file for complete search history.

(56) References Cited

U.S. PATENT DOCUMENTS 9,167,654 B2 * 10/2015 Watanabe ..... H05B 33/0815
9,295,138 B2 * 3/2016 Kumada ..... H05B 37/02
9,474,114 B2 * 10/2016 Nakamura ..... H05B 33/0809
9,485,820 B2 * 11/2016 Ido ..... H05B 33/0815
2009/0212718 A1 8/2009 Kawashima et al.
(Continued)

FOREIGN PATENT DOCUMENTS

JP 2002-367789 A 12/2002
JP 2004-327175 A 11/2004
(Continued)

*Primary Examiner* — Vibol Tan
(74) *Attorney, Agent, or Firm* — McDermott Will & Emery LLP

(57) ABSTRACT

A lighting control device includes: a power supply circuit and a first controller. The first controller includes a first control circuit, a signal output circuit and a first interface. The first control circuit is configured to allow the signal output circuit to output a light control signal to the power supply circuit. The signal output circuit is configured to output the light control signal for indicating magnitude of the output power to the power supply circuit. The first control circuit is configured to transmit control information to and receive the control information from a second controller through the first interface. When the control information is received from the second controller through the first interface, the first control circuit is configured to allow the signal output circuit to output the light control signal corresponding to the control information to the power supply circuit.

8 Claims, 4 Drawing Sheets

(56) References Cited

U.S. PATENT DOCUMENTS

| | | | | |
|---|---|---|---|---|
| 2016/0174316 | A1* | 6/2016 | Hori | H05B 33/0866 315/186 |
| 2016/0212815 | A1* | 7/2016 | Watanabe | H05B 33/0845 |
| 2016/0374168 | A1* | 12/2016 | Ackmann | H05B 33/0845 |
| 2016/0381751 | A1* | 12/2016 | Bong | H05B 33/0845 315/193 |

FOREIGN PATENT DOCUMENTS

| | | | |
|---|---|---|---|
| JP | 2008-204916 | A | 9/2008 |
| JP | 2009-205841 | A | 9/2009 |
| JP | 2013-165004 | A | 8/2013 |

* cited by examiner

LIGHTING CONTROL DEVICE, LIGHTING APPARATUS AND LUMINAIRE

CROSS-REFERENCE TO RELATED APPLICATIONS

The application is based upon and claims the benefit of priority of Japanese Patent Application No. 2015-139401, filed on Jul. 13, 2015, the entire content of which is incorporated herein by reference,

TECHNICAL FIELD

The disclosure relates generally to lighting control devices, lighting apparatuses and luminaires and, more particularly, to: a lighting control device that includes a power supply circuit and a controller; a lighting apparatus that includes the lighting control device and a light source; and a luminaire that includes the lighting apparatus and a luminaire body.

BACKGROUND ART

As a conventional example, there has been a lighting control system that is disclosed in JP 2013-165004 A (hereinafter, referred to as "Document 1"). The lighting control system (hereinafter, referred to as the "conventional example") in Document 1 includes a controller (a lighting control device), a communication unit, a lighting apparatus, a setting device and the like. The controller includes a memory that stores setting data for initial illuminance correction. The setting data is data to be used for setting a pattern of changing a dimming rate (light control level) of a light source of the lighting apparatus with passage of an accumulated lighting time of the light source. The controller reads out, from the memory, the dimming rate's pattern with the passage of the accumulated lighting time to transmit it to the lighting apparatus. The lighting apparatus performs lighting control of an LED (light-emitting diode) as the light source, in accordance with the dimming rate's pattern received from the controller.

Incidentally, an object of this conventional example is to enable to perform appropriate initial illuminance correction to various types of light sources (that includes a light source and the like newly made into a product after use of this system) by rewriting the setting data stored in the memory of the controller. In other words, this conventional example in Document 1 can deal with extension of a function that does not need additional hardware, but cannot deal with extension of a function that needs additional hardware.

SUMMARY

The present disclosure is directed to a lighting control device, a lighting apparatus and a luminaire, which can easily deal with extension of a function that needs additional hardware.

A lighting control device, for controlling a light source, of an aspect according to the present disclosure includes: a power supply circuit configured to perform power conversion with power received from an external power source, and supply converted power as output power to the light source; and a first controller configured to control the power supply circuit to adjust the output power to be supplied to the light source. The first controller includes a first control circuit, a signal output circuit and a first interface. The first control circuit is configured to allow the signal output circuit to output a light control signal to the power supply circuit. The signal output circuit is configured to output the light control signal for indicating magnitude of the output power to the power supply circuit. The first control circuit is configured to transmit control information to and receive the control information from a second controller through the first interface. When the control information is received from the second controller through the first interface, the first control circuit is configured to allow the signal output circuit to output the light control signal corresponding to the control information to the power supply circuit.

A lighting apparatus of an aspect according to the present disclosure includes: the lighting control device; and the light source that receives the output power of the lighting control device to emit light.

A luminaire of an aspect according to the present disclosure includes: the lighting apparatus; and a luminaire body that supports the lighting apparatus.

BRIEF DESCRIPTION OF THE DRAWINGS

The figures depict one or more implementations in accordance with the present disclosure, by way of example only, not by way of limitations. In the figures, like reference numerals refer to the same or similar elements.

DETAILED DESCRIPTION

Hereinafter, a lighting control device A, a lighting apparatus B and a luminaire C according to this embodiment will be described with reference to the figures. Note that, a configuration in this embodiment is merely one example. In this embodiment, numerous modifications and variations can be made in accordance with the design and the like without departing from the technical idea according to the present disclosure.

Figure 1:
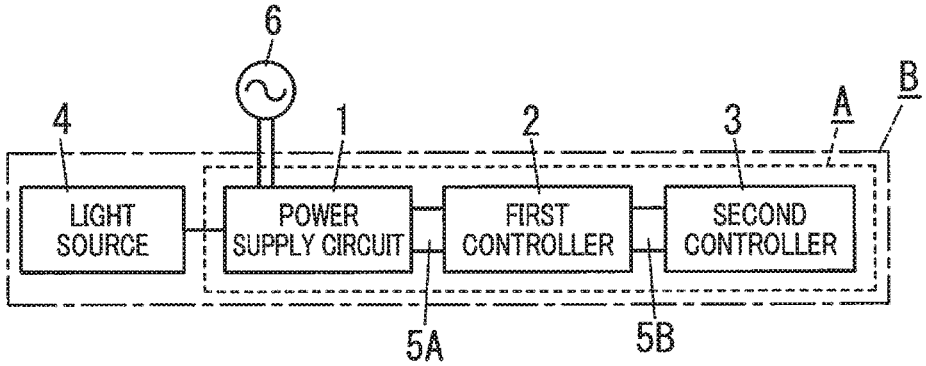
FIG. 1 is a block diagram illustrating a lighting control device and a lighting apparatus according to an embodiment.

The lighting apparatus B according to this embodiment, as shown in FIG. 1, includes the lighting control device A, and a light source 4 that receives output power of the lighting control device A to emit light. The lighting control device A according to this embodiment, as shown in FIG. 1, includes a power supply circuit 1 and a first controller 2. The lighting control device A according to this embodiment further includes a second controller 3. The power supply circuit 1 and the first controller 2 are electrically connected to each other with a first connection medium 5A. Also, the first controller 2 and the second controller 3 are electrically connected to each other with a second connection medium 5B.

Figure 2A:
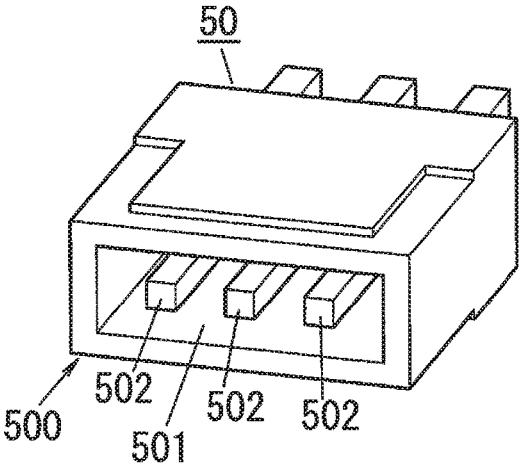
FIG. 2A is a perspective view of a receptacle connector in the lighting control device according to the embodiment.
Figure 2B:
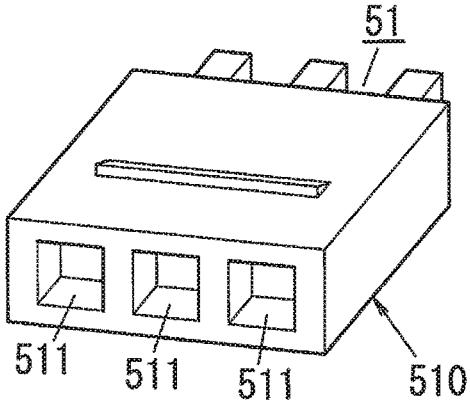
FIG. 2B is a perspective view of a plug connector in the lighting control device according to the embodiment.
Figure 2C:
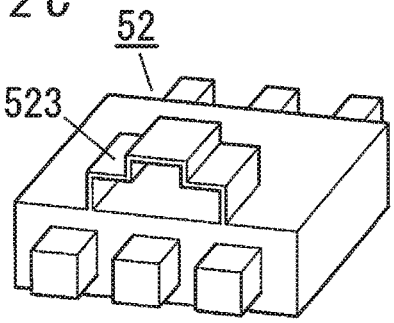
FIG. 2C is a perspective view of a variation of the receptacle connector in the lighting control device according to the embodiment.
Figure 2D:
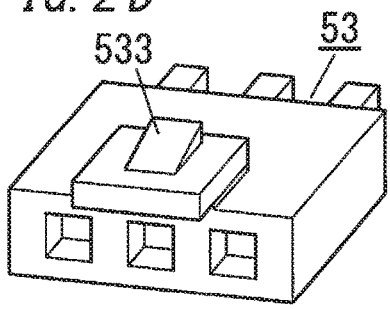
FIG. 2D is a perspective view of a variation of the plug connector in the lighting control device according to the embodiment.

The first connection medium 5A includes a receptacle connector 50 and a plug connector 51 as respectively shown in FIGS. 2A and 2B, or a receptacle connector 52 and a plug connector 53 as respectively shown in FIGS. 2C and 2D, for example. Also the second connection medium 5B includes the receptacle connector 50 and the plug connector Si as respectively shown in FIGS. 2A and 2B, or the receptacle connector 52 and the plug connector 53 as respectively shown in FIGS. 2C and 2D, for example. The receptacle connector 50 shown in FIG. 2A includes a housing 500 that has a rectangular parallelepiped shape, and a recess 501 is provided in the housing 500. The receptacle connector 50 is formed such that two or more contacts 502 (three in the illustrated example) are arranged at equal intervals in the recess 501. On the other hand, the plug connector 51 shown in FIG. 2B includes a housing 510 that has a rectangular parallelepiped shape, and two or more recesses 511 (three in the illustrated example) are provided in the housing 510. The plug connector 51 is formed such that two or more contact rests are respectively housed in the two or more recesses 511. In other words, the housing 510 of the plug connector 51 is to be inserted into the recess 501 of the housing 500 of the receptacle connector 50. Further, the two or more contacts 502 of the receptacle connector 50 are to be respectively inserted into the two or more recesses 511 of the housing 510 of the plug connector 51 to be electrically connected to the two or more contact rests. Note that, the connection state of the receptacle connector 50 and the plug connector 51 can be kept by the spring force (elastic force) of the two or more contact rests.

On the other hand, the receptacle connector 52 and the plug connector 53 shown in FIGS. 2C and 2D each includes a lock mechanism for keeping the connection state, and are different from the receptacle connector 50 and the plug connector 51 shown in FIGS. 2A and 2B in that the lock mechanism is provided. The lock mechanism includes a lock claw 533 provided at the plug connector 53 and a receiving part 523 provided at the receptacle connector 52, for example. The lock mechanism is locked by the lock claw 533 being inserted into the receiving part 523 and hooked to a projection formed in the receiving a part 523, and accordingly, the connection state of the receptacle connector 52 and the plug connector 53 can be kept.

Note that, the first and second connection mediums 5A and 5B are not limited to the above mentioned connectors. The mediums 5A and 5B each may include a cable in which two or more electric wires (conductors) are covered with a sheath, and the like.

Figure 3:
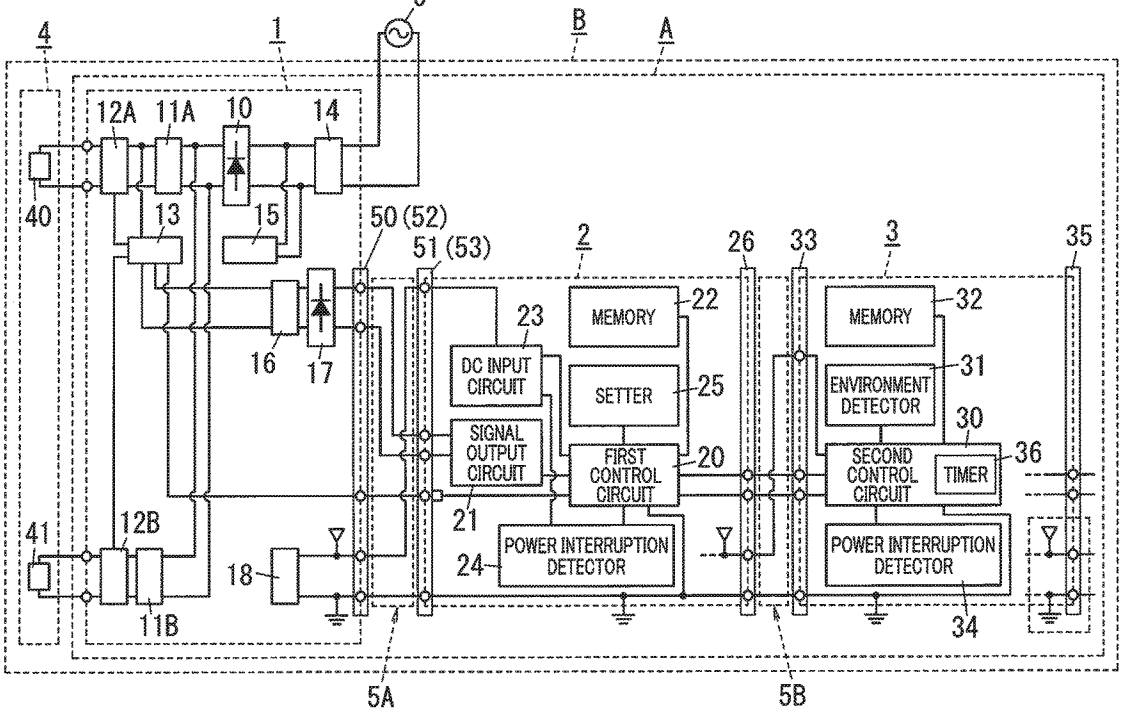
FIG. 3 is a circuit block diagram illustrating the lighting control device and the lighting apparatus according to the embodiment.

As shown in FIG. 3, the power supply circuit 1 includes a first rectifier circuit 10, a first step-up chopper circuit 11A, a second step-up chopper circuit 11B, a first step-down chopper circuit 12A, a second step-down chopper circuit 12B and a control circuit 13, for example. The power supply circuit 1 further includes a noise prevention circuit 14, a lightning surge protection circuit 15, a DC-DC conversion circuit 16, a second rectifier circuit 17 and an operation power supply circuit 18.

The first rectifier circuit 10 is formed as a full-wave rectifier circuit that performs full-wave rectification of an AC voltage received from an external power source (commercial AC power source) 6. The full-wave rectifier circuit is a diode bridge circuit.

The first and second step-up chopper circuits 11A and 11B are electrically connected in parallel to each other between output terminals, paired, of the first rectifier circuit 10. The first and second step-up chopper circuits 11A and 11B are power factor improvement circuits, each of which increases a pulsating voltage output from the first rectifier circuit 10 to improve a power factor.

The first step-down chopper circuit 12A is electrically connected between output terminals, paired, of the first step-up chopper circuit 11A. The first step-down chopper circuit 12A is configured to reduce a DC voltage output from the first step-up chopper circuit 11A, and output the reduced voltage to (a first LED module 40 of) the light source 4. The second step-down chopper circuit 12B is electrically connected between output terminals, paired, of the second step-up chopper circuit 11B. The second step-down chopper circuit 12B is configured to reduce a DC voltage output from the second step-up chopper circuit 11B, and output the reduced voltage to (a second LED module 41 of) the light source 4.

The control circuit 13 is a circuit for controlling the first and second step-down chopper circuits 12A and 12B, and is preferable to be configured by a control IC (Integrated Circuit), or a microcontroller.

The noise prevention circuit 14 is a filter circuit that is disposed on the input side of the first rectifier circuit 10, and is preferable to he configured by e.g., a single noise filter that includes a choke coil.

The lightning surge protection circuit 15 is a circuit for preventing dielectric breakdown of the power supply circuit 1 or the light source 4 that occurs due to lightning surge, and is preferable to include a surge absorption element and the like, for example.

The DC-DC conversion circuit 16 is a circuit that converts a light control signal as a PWM (Pulse Width Modulation) signal into a DC voltage signal proportional to a duty ratio of the PWM signal and outputs the DC voltage signal.

The control circuit 13 is configured to adjust outputs of the first step-down chopper circuit 12A and the second step-down chopper circuit 12B in accordance with a level of the DC voltage signal (light control signal) output from the DC-DC conversion circuit 16 in order to modulate a light output of the light source 4.

The control circuit 13 is further configured to sense an abnormality of the power supply circuit 1 or the light source 4, and transmit information relating to the sensed abnormality (hereinafter, referred to as "abnormality sensing information") to the outside (including the first controller 2). For example, the control circuit 13 measures output currents of the first step-down chopper circuit 12A and the second step-down chopper circuit 12B while the operation for lighting the light source 4 is performed, and compares a measured value of each output current with a prescribed threshold value to sense non-lighting of the light source 4. In other words, when an open circuit failure occurs in the light source 4, a current fails to flow from the power supply circuit 1 to the light source 4, and as a result, the measured value of the output current falls below the threshold value. Therefore, the control circuit 13 can sense non-lighting of the light source 4. In addition, the control circuit 13 measures a leakage current that occurs in the power supply circuit 1, or senses (determines) presence or absence of a short-circuit failure, presence or absence of an abnormal increase in a voltage or the like. When sensing the abnormality as above, the control circuit 13 transmits the abnormality sensing information including a type (content) of sensed abnormality to the first controller 2 via the receptacle connector 50.

The second rectifier circuit 17 is a full-wave rectifier circuit that is disposed in preceding stage of the DC-DC conversion circuit 16, and can make a transmission line (i.e., a conductor included in the first connection medium 5A) non-polar, through which the PWM signal is transmitted.

The operation power supply circuit 18 is configured to generate an operation voltage (a DC voltage of about 3.3 [V] to 5 [V], for example), using an output voltage (pulsating voltage) of the first rectifier circuit 10. Such the operation power supply circuit 18 is preferable to include a series regulator or a switching regulator. The operation voltage (operation power) generated by the operation power supply circuit 18 is supplied to the step-up chopper circuits, the step-down chopper circuits, the control circuit and the like that constitute the power supply circuit 1. In addition, this operation voltage (operation power) is supplied also to the first controller 2 through the first connection medium 5A.

As shown in FIG. 3, the light source 4 includes the first LED module 40 and the second LED module 41. The first and second LED modules 40 and 41 are formed by a large number of light-emitting diodes (LEDs) being mounted on a surface of a substrate that has a rectangular flat plate shape, for example. Those LEDs are electrically connected to each other with an electric conductor (copper foil) formed on the surface of the substrate. Furthermore, the substrate is provided thereon with a connector and the like to be electrically connected to an output terminal of the power supply circuit 1 with an electric wire. As shown in FIG. 3, the first LED module 40 is configured to be electrically connected between output ends of the first step-down chopper circuit 12A so as to emit light with a DC current supplied from the first step-down chopper circuit 12A. On the other hand, the second LED module 41 is configured to be electrically connected between output ends of the second step-down chopper circuit 12B so as to emit light with a DC current supplied from the second step-down chopper circuit 12B.

As shown in FIG. 3, the first controller 2 includes a first control circuit 20, alight control signal output circuit (hereinafter, signal output circuit) 21 and a first interface 26. The first controller 2 further includes a memory 22, a DC input circuit 23, a power interruption detector 24 and a setter 25.

Figure 4:
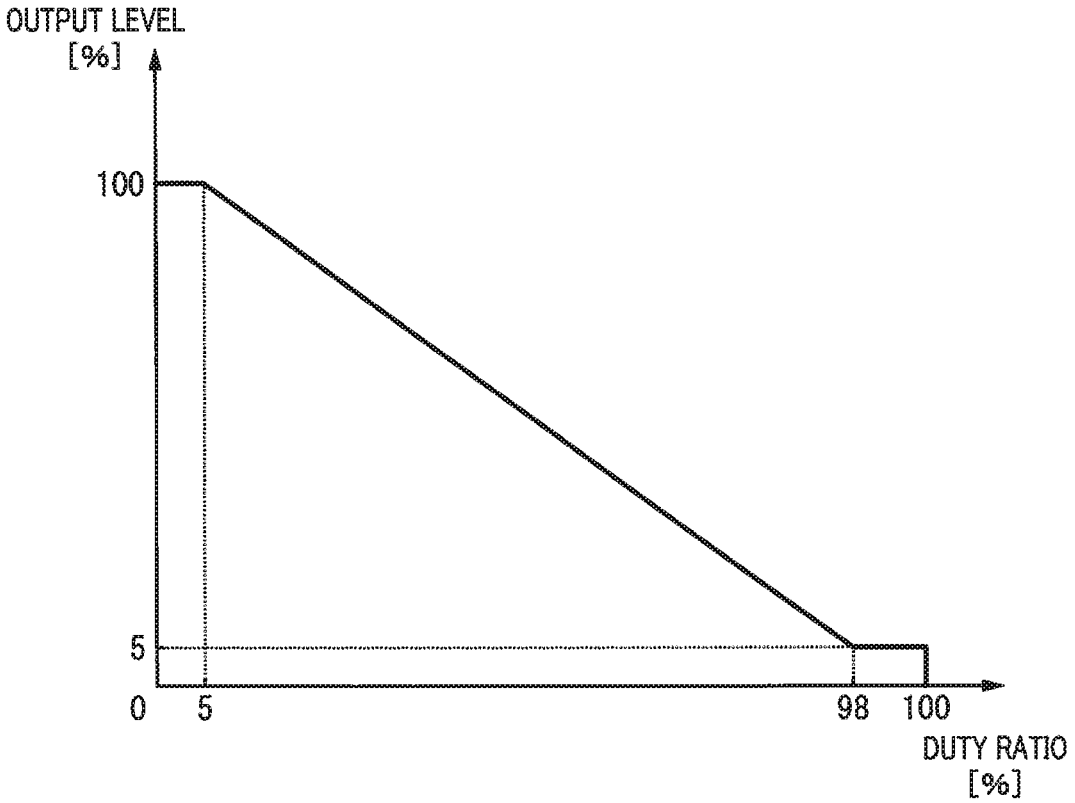
FIG. 4 is an explanatory diagram illustrating a relationship between a duty ratio and an output level in the lighting control device according to the embodiment.

The signal output circuit 21 is configured to generate a PWM (Pulse Width Modulation) signal with a duty ratio that corresponds to a light control level indicated by the first control circuit 20, and output this PWM signal (light control signal) to the power supply circuit 1 via the first connection medium 5A. FIG. 4 shows a relationship between the light control level (i.e., an output level of DC power (DC current), which the power supply circuit 1 supplies to the light source 4) and the duty ratio of the PWM signal. As shown in FIG. 4, when the duty ratio is in 0 to 5 [%], the light control level (output level) is set to 100 [%], and further when the duty ratio is equal to or more than 98 [%] (except 100 [%]), the light control level (output level) is set to 5 [%] (a lower limit value). When the duty ratio is more than 5 [%] and less than 98 [%], the light control level (output level) is reduced at a fixed ratio with an increase of the duty ratio. As a result, the signal level voltage value) of the DC voltage signal (light control signal), output from the DC-DC conversion circuit 16 of the power supply circuit 1, becomes maximum at the lower limit value (5 [%]) of the light control level (output level), and minimum at a rated value of the light control level (output level). However, the relationship shown in FIG. 4 is merely one example. Accordingly, the relationship between the light control level (output level) and the duty ratio is not limited to the example of FIG. 4.

When the signal level of the light control signal output from the DC-DC conversion circuit 16 is at the maximum value, the control circuit 13 of the power supply circuit 1 adjusts the output currents of the first and second step-down chopper circuits 12A and 12B to a lower limit value, and, when the signal level is at the minimum value, the output currents to a rated value. When the signal level of the light control signal is at zero, the control circuit 13 basically adjusts the output currents of the first and second step-down chopper circuits 12A and 12B to the rated value. However, immediately after the external power source 6 is turned on, output voltages of the first step-up chopper circuit 11A and the second step-up chopper circuit 11B do not reach a rated voltage, and accordingly, output voltages of the first and second step-down chopper circuits 12A and 12B are unstable. For this reason, until a prescribed time elapses after the external power source 6 is turned on (hereinafter, referred to as a "preparation period"), the control circuit 13 does not accept the light control signal and does stop the operation of the first and second step-down chopper circuits 12A and 12B. In other words, since the power supply circuit 1 supplies no power during the preparation period, the light source 4 is kept in a non-lighting state. Then during the preparation period, the output voltages of the first and second step-up chopper circuit 11A and 11B become stable. After the preparation period, the control circuit 13 starts the operation of the first and second step-down chopper circuits 12A and 12B to supply, to the light source 4, the DC power having the output level corresponding to the light control signal. Therefore, the light source 4 emits light at the light control level indicated by the light control signal.

The first control circuit 20 is preferable to be a microcontroller. The first control circuit 20 adjusts the light control level to be indicated to the signal output circuit 21, based on control information received from the second controller 3. Furthermore, the first control circuit 20 receives the abnormality sensing information from the power supply circuit 1 via the first connection medium 5A and transmits a stop command to the control circuit 13 of the power supply circuit 1, based on the received abnormality sensing information. When receiving the stop command, the control circuit 13 stops the operation of the first and second step-down chopper circuits 12A and 12B. When receiving the stop command, the control circuit 13 also stops the operation of the first and second step-up chopper circuit 11A and 11B. However, instead of transmission of the stop command, the first control circuit 20 may adjust the light control level to the lower limit value, and allows the signal output circuit 21 to output the light control signal (PWM signal) corresponding to the light control level adjusted to the lower limit value.

The first interface 26 includes a receptacle connector that has the same configuration as the receptacle connector 50 shown in FIG. 2A or the receptacle connector 52 shown in FIG. 2C, for example. Alternatively, the first interface 26 may include a plug connector that has the same configuration as the plug connector 51 shown in FIG. 2B or the plug connector 53 shown in FIG. 2D. Note that, the first interface 26 further includes a serial bus (transmission line) described later and a power supply line for the operation voltage (operation power) (see FIG. 3).

The memory 22 may be made of a non-volatile semiconductor memory (such as a flash memory or an EEPROM (Electrically Erasable Programmable Read-only Memory)), which can be electrically rewritten by the first control circuit 20. The memory 22 stores a type (model number) of power supply circuit 1 that is available in combination with the first controller 2, rated values (rated currents, rated voltages and the like) respectively corresponding to two or more types (model numbers), a lot number of the first controller 2, and the like.

The DC input circuit 23 includes a power storage element. Examples of the power storage element include an electrolytic capacitor, an electric double layer capacitor, a secondary battery (such as a lithium ion battery), and the like. The DC input circuit 23 is configured to charge the power storage element (stores power) with the operation voltage supplied from the operation power supply circuit 18 of the power supply circuit 1 via the first connection medium 5A, and supply the operation voltage to the first control circuit 20 and the like. When the operation power supply circuit 18 of the power supply circuit 1 stops supplying of the operation voltage, the DC input circuit 23 releases electric energy stored in the power storage element (discharging of electric power), which can continue supplying of the operation voltage during certain period (several seconds or several minutes).

The power interruption detector 24 is configured to measure the operation voltage supplied from the operation power supply circuit 18 of the power supply circuit 1 to the DC input circuit 23 to detect a power interruption of the external power source 6. When detecting the power interruption, the power interruption detector 24 is configured to output a power interruption detecting signal to the DC input circuit 23. When receiving the power interruption detecting signal, the DC input circuit 23 discharge the electric energy stored in the power storage element to supply the operation voltage to the first control circuit 20.

The setter 25 may include e.g., a DIP switch. The setter 25 is configured to alternatively set setting values, such as a use application (use outdoor or use indoor, or use in house or use in place other than house) of the lighting apparatus B according to this embodiment, a rated current (200 [mA] or 400 [mA]) and a magnification (0.8 times, 0.9 times, 1.1 times or the like). For example, the first control circuit 20 reads the setting content of the setter 25 upon activation of the device, and stores it in the memory 22.

The memory 22 stores two or more data tables respectively corresponding to two or more use applications of the lighting apparatus B, for example. In other words, when the relationship between the light control level (output level) and the duty ratio (FIG. 4 shows one example of the relationship) changes, depending on each of the two or more use applications, data of the relationship respectively corresponding to the two or more use applications are stored in the two or more data tables.

The first control circuit 20 refers to a data table corresponding to the setting content of the setter 25, stored in the memory 22, to determine the light control level to be indicated to the power supply circuit 1.

As shown in FIG. 3, the second controller 3 includes a second control circuit 30, an environment detector 31, a memory 32, a second interface 33, a power interruption detector 34, a third interface 35, a timer 36 and the like.

The environment detector 31 is configured to detect an ambient environment, such as presence of an ambient moving object (a human, a vehicle or the like), an ambient brightness (illuminance) or an ambient temperature (atmospheric temperature). To detect presence of the moving object, for example the environment detector 31 detects infrared rays emitted from a human body with a pyroelectric element, measures a distance to an object by transmitting ultrasonic waves or millimeter waves, or captures an ambient image. When detecting presence of the moving object, the environment detector 31 is configured to output a detection signal.

The second control circuit 30 is preferable to be a microcontroller. In this case, the memory 32 previously stores, as data tables, a relationship between a signal level of the detection signal and the light control level. Note that, values of the data tables stored in the memory 22 described above are also reflected in the data tables stored in the memory 32. When receiving the detection signal from the environment detector 31, the second control circuit 30 refers to the data tables in the memory 32 to determine the light control level (control information) corresponding to the detection signal. The second control circuit 30 transmits the determined light control level to the first control circuit 20 of the first controller 2 by serial communication such as UART (Universal Asynchronous Receiver/Transmitter). For example, when receiving the detection signal that indicates detection of the moving object, the second control circuit 30 modifies the light control level from a first level (e.g., 50 [%]) to a second level (e.g., 90 [%]), and transmits (indicates) the modified light control level second level) to the first control circuit 20. When a prescribed waiting time elapses after reception of the last detection signal, the second control circuit 30 modifies the light control level from the second level to the first level, and transmits (indicates) the modified light control level (first level) to the first control circuit 20. In this case, it is possible to save energy by the lighting apparatus B reducing a light quantity (light flux) when no moving object (e.g., no human) exists, and increasing the light quantity when a moving object exists.

The second control circuit 30 may have an initial illuminance correction function. The initial illuminance correction function is a function to adjust a light output of the light source 4 in accordance with an accumulated lighting time of the light source 4 so as to keep the light output approximately constant (e.g., 85 [%] of a rated value) from the use start of the light source 4 to the life end thereof. In other words, the second control circuit 30 clocks the accumulated lighting time of the light source 4 with the timer 36 installed in the microcontroller to store it in the memory 32, and refers to an initial illuminance correction characteristic stored in the data table to determine the light control level corresponding to the accumulated lighting time. The initial illuminance correction characteristic is a characteristic such that the light control level is gradually increased with an increase in the accumulated lighting time.

The second control circuit 30 further receives the abnormality sensing information (e.g., information that indicates sensing of non-lighting of the light source 4) of the power supply circuit 1 from the first control circuit 20 via the second connection medium 5B, and stores the received abnormality sensing information in the memory 32. In addition when receiving a request from the outside, the second control circuit 30 outputs the latest abnormality sensing information stored in the memory 32 to a source (outside) that transmitted the request. In this case, the second control circuit 30 outputs, to the outside, an identification code corresponding to a type of abnormality sensing included in the abnormality sensing information. The output destination of the abnormality sensing information (identification code) is assumed to be a server or the like operated by a maintenance company that carries out maintenance and management of the lighting apparatus B (or the luminaire C).

The memory 32 may be made of a non-volatile semiconductor memory (such as a flash memory or an EEPROM), which can be electrically rewritten by the second control circuit 30. The memory 32 stores the accumulated lighting time of the light source 4, the abnormality sensing information and the like, as described above.

The second interface 33 is formed to be detachably connected electrically and mechanically to the first interface 26 of the first controller 2. The second interface 33 includes a plug connector that has the same configuration as the plug connector 51 shown in FIG. 2B or the plug connector 53 shown in FIG. 2D, for example. Alternatively, the second interface 33 may include a receptacle connector that has the same configuration as the receptacle connector 50 shown in FIG. 2A or the receptacle connector 52 shown in FIG. 2C. Note that, the second interface 33 further includes transmission lines (two lines for two-way) for serial communication such as UART, and a power supply line for the operation voltage (operation power) (see FIG. 3).

The third interface 35 includes a receptacle connector that has the same configuration as the receptacle connector 50 shown in FIG. 2A or the receptacle connector 52 shown in FIG. 2C, for example. Alternatively, the third interface 35 may include a plug connector that has the same configuration as the plug connector 51 shown in FIG. 2B or the plug connector 53 shown in FIG. 2D. Note that, the third interface 35 further includes transmission lines (two lines for two-way) for serial communication such as UART, and a power supply line for the operation voltage (operation power) (see FIG. 3).

The power interruption detector 34 is configured to measure a voltage of the power supply line of the second interface 33 to detect the power interruption of the external power source 6. When detecting the power interruption, the power interruption detector 34 is configured to output a power interruption detecting signal to the second control circuit 30. When receiving the power interruption detecting signal, the second control circuit 30 write the accumulated lighting time, clocked by the timer 36 installed in the microcontroller, into the memory 32.

The second controller 3 is configured to operate with the operation voltage (operation power) supplied from the operation power supply circuit 18 of the power supply circuit 1 via the first controller 2. However, there is also a case where it is difficult for the second controller 3 to operate with the operation voltage supplied from the operation power supply circuit 18, depending on the configuration of the environment detector 31. For example when the environment detector 31 includes an active type sensor, such as a millimeter-wave-radar, it may be difficult to operate with the operation voltage supplied from the operation power supply circuit 18. In such a case, the second controller 3 may include a power supply circuit (such as a series regulator or a switching regulator) that generates an operation voltage (operation power), using power of the external power source 6.

For example, a third controller 3A (shown in FIG. 5), a fourth controller 3B (shown in FIG. 6) or the like is appropriately connected electrically and mechanically to the third interface 35 of the second controller 3.

Figure 5:
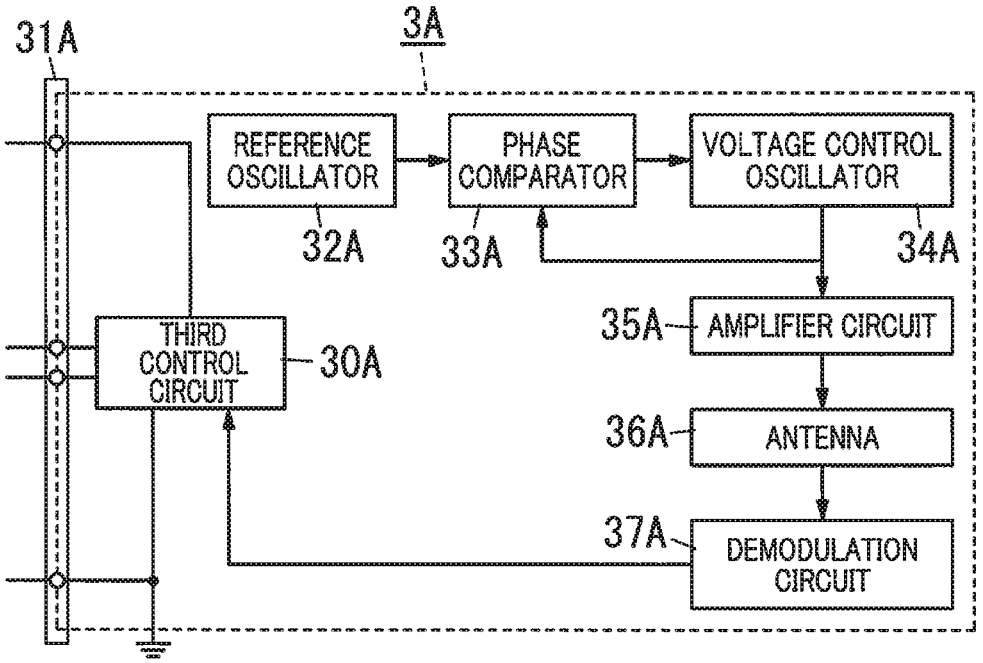
FIG. 5 is a circuit block diagram illustrating a third controller of the lighting control device according to the embodiment.

The third controller 3A is configured to perform radio communication, using radio waves as a medium. For this reason, as shown in FIG. 5, the third controller 3A includes a third control circuit 30A, a fourth interface 3 LA, a reference oscillator 32A, a phase comparator 33A, a voltage control oscillator 34A, an amplifier circuit 35A, an antenna 36A, a demodulation circuit 37A and the like.

The third control circuit 30A is preferable to be a microcontroller. The third control circuit 30A transmits/receives radio communication data (transmission data and reception data) to/from the second control circuit 30 of the second controller 3 by serial communication such as UART.

The fourth interface 31A is formed to be detachably connected electrically and mechanically to the third interface 35 of the second controller 3. The fourth interface 31A includes a plug connector that has the same configuration as the plug connector 51 shown in FIG. 2B or the plug connector 53 shown in FIG. 2D, for example. Alternatively, the fourth interface 31 A may include a receptacle connector that has the same configuration as the receptacle connector 50 shown in FIG. 2A or the receptacle connector 52 shown in FIG. 2C. Note that, the fourth interface 31A further includes transmission lines (two lines for two-way) for serial communication such as UART, and a power supply line for the operation voltage (operation power) (see FIG. 5).

In the third controller 3A, the reference oscillator 32A, the phase comparator 33A, the voltage control oscillator 34A and the amplifier circuit 35A constitute an FSK (Frequency Shift Keying) modulation circuit. The reference oscillator 32A oscillates a reference signal with a carrier frequency. The phase comparator 33A compares a phase of an output of the voltage control oscillator 34A with a phase of the reference signal, and outputs, to the voltage control oscillator 34A, a signal obtained by filtering the comparison result (a phase difference) with a low pass filter. The voltage control oscillator 34A adjusts an output frequency in accordance with a voltage of the output signal of the phase comparator 33A. In other words, the phase comparator 33A and the voltage control oscillator 34A constitute a PLL (Phase Locked Loop) circuit. The output frequency of the voltage control oscillator 34A is changed by a baseband signal having a transmission frame to be output from the third control circuit 30A, and accordingly, a modulation signal subjected to the FSK modulation is input to the amplifier circuit 35A. The amplifier circuit 35A amplifies the modulation signal, and outputs it to the antenna 36A. The antenna 36A converts the modulation signal into radio waves, and radiates (transmits) the radio waves.

The demodulation circuit 37A is configured to demodulate a reception frame from a signal received with the antenna 36A (i.e., FSK demodulation). The demodulation circuit 37A outputs the demodulated reception frame to the third control circuit 30A.

Figure 6:
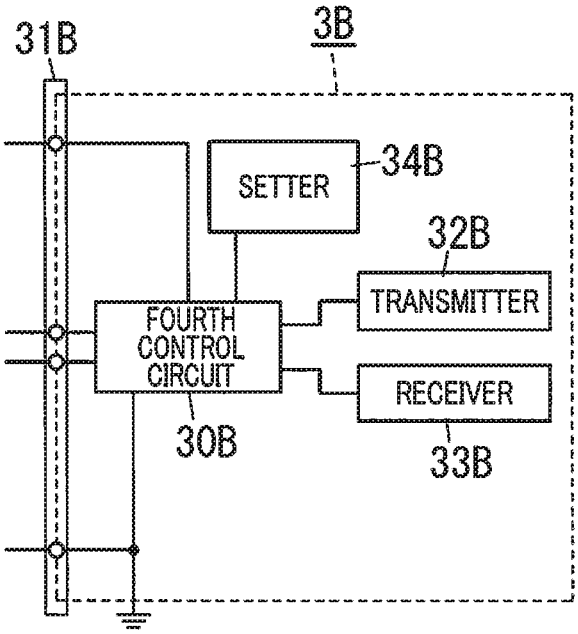
FIG. 6 is a circuit block diagram illustrating a fourth controller of the lighting control device according to the embodiment.

The fourth controller 3B is configured to perform radio communication, using infrared rays as a medium. For this reason, as shown in FIG. 6, the fourth controller 3B includes a fourth control circuit 30B, a fifth interface 31B, a transmitter 32B, a receiver 33B, a setter 34B and the like.

The fourth control circuit 30B is preferable to be a microcontroller. The fourth control circuit 309 transmits/receives radio communication data (transmission data and reception data) to/from the third control circuit 30A of the third controller 3A by serial communication such as UART.

The fifth interface 31B is formed to be detachably connected electrically and mechanically to the fourth interface 31A of the third controller 3A. The fifth interface 31B includes a receptacle connector that has the same configuration as the receptacle connector 50 shown in FIG. 2A or the receptacle connector 52 shown in FIG. 2C, for example. Alternatively, the fifth interface 31B may include a plug connector that has the same configuration as the plug connector 51 shown in FIG. 2B or the plug connector 53 shown in FIG. 2D. Note that, the fifth interface 31B further includes transmission lines (two lines for two-way) for serial communication such as UART, and a power supply line for the operation voltage (operation power) (see FIG. 6).

The transmitter 329 includes one or more infrared light-emitting diodes, and a drive circuit for driving the one or more infrared light-emitting diodes (i.e., for making the diodes emit light). The drive circuit is configured to blink the one or more infrared light-emitting diodes in accordance with a transmission code (transmission data) given by the fourth control circuit 30B.

The receiver 33B may include a light receiving element that is a photodiode or a phototransistor. The receiver 33B is configured to demodulate a reception code (reception data) from infrared rays received with the light receiving element, and output the demodulated reception code (reception data) to the fourth control circuit 30B.

The setter 34B may include e.g., a DIP switch. For example, the setter 34B is configured to set a channel (frequency) to be used for the infrared communication by the transmitter 32B and the receiver 33B. In other words, the fourth control circuit 30B reads a setting value of the setter 34B and selects the channel in accordance with the read setting value.

Note that, the fourth controller 3B may be configured to operate with not the operation voltage supplied via the third controller 3A but a DC voltage supplied from a battery (such as a button type primary battery).

Figure 7:
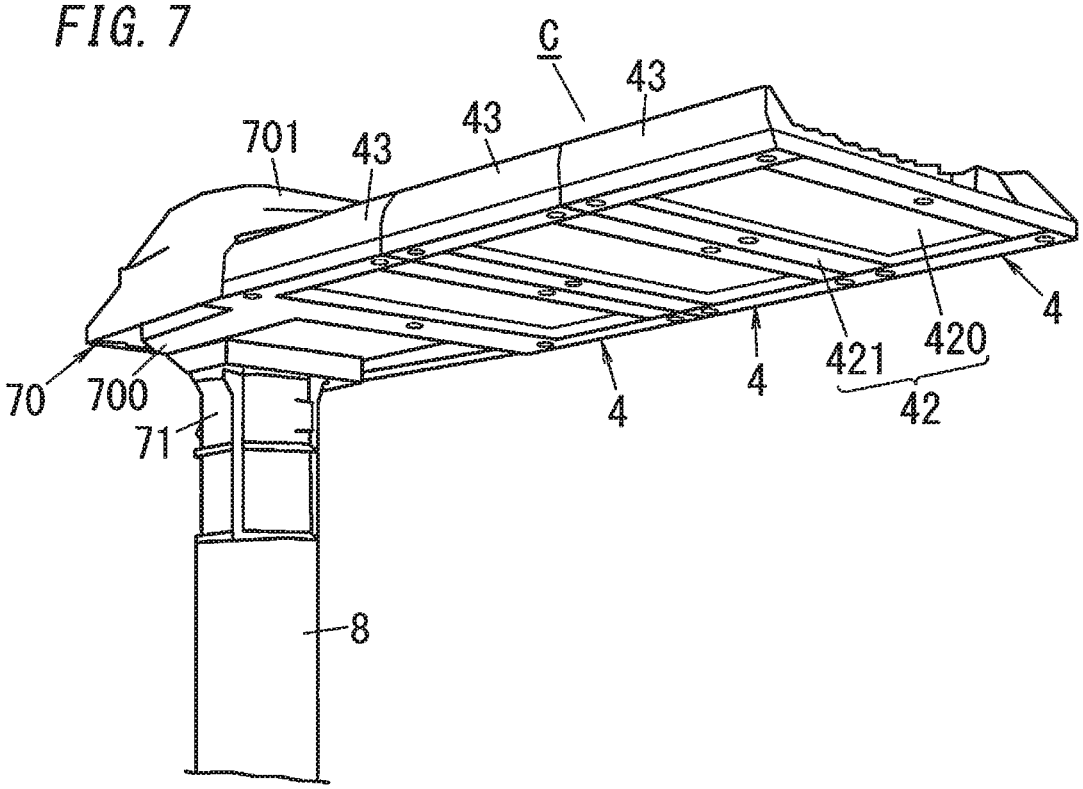
FIG. 7 is a perspective view of a luminaire according to the embodiment.

As shown in FIG. 7, the luminaire C according to this embodiment is a luminaire for road lighting (road lamp). However, the luminaire according to this embodiment may be a luminaire, such as a security lamp or a street lamp, other than such the luminaire for road lighting.

As shown in FIG. 7, the luminaire C according to this embodiment includes two or more light sources 4 (three in the illustrated example), a luminaire body 70 and an adapter 71. The adapter 71 is a component for mechanically connecting the luminaire body 70 to a lighting pole 8 for lighting.

The luminaire body 70 includes a body 700 and an upper lid 701. The body 700 is formed by aluminum die casting so as to have a rectangular fiat box shape, a top face of which is opened. The upper lid 701 is formed by aluminum die casting so as to have a rectangular flat box shape, a bottom face of which is opened. The upper lid 701 is attached to the body 700 to be turned between an open position where an opening of the body 700 is opened; and a close position where the opening of the body 700 is closed. Note that, the upper lid 701 is fixed at the close position by both of right and left ends on the free end's side thereof being screwed to the body 700.

The luminaire body 70 houses therein the lighting control device A according to this embodiment, namely, the power supply circuit 1, the first controller 2, the second controller 3, a terminal block and the like. The terminal block is electrically connected to a power line that is wired so as to be raised upward in the lighting pole 8. The power supply circuit 1 is electrically connected to the power line via the terminal block. The power supply circuit I receives AC power from the external power source 6 via the power line. The luminaire body 70 is attached to an end of the lighting pole 8 with the adapter 71 (see FIG. 7).

Each light source 4 includes a unit body 43 and a cover 42. The unit body 43 is formed by aluminum die casting so as to have a plate shape having four sides. The cover 42 includes a light transmitting plate 420, a frame body 421 and the like. The light transmitting plate 420 is formed of material having a light-transmitting property (e.g., synthetic resin material, such as acrylic resin, or quartz glass) so as to have a rectangular flat plate shape. The frame body 421 is formed by aluminum die casting so as to have a rectangular frame. The cover 42 is disposed to cover a bottom surface of the unit body 43, and attached to the unit body 43 by the frame body 421 being screwed to the unit body 43.

The three light sources 4 are connected along a width direction thereof A rear end light sources 4 of the connected three light sources 4 is fixed to a front end of the luminaire body 70 (see FIG. 7). The connection of the adjacent light sources 4 to each other and the fixing of the rear end light source 4 to the luminaire body 70 are performed by screws, for example.

Incidentally, the smallest number of constituent units, which constitute the lighting control device A according to this embodiment, is two: the power supply circuit 1 and the first controller 2. The lighting control device A constituted by the power supply circuit 1 and the first controller 2 operates as follow, for example.

The first control circuit 20 of the first controller 2 reads the data table corresponding to the setting content of the setter 25, stored in the memory 22, and determines the light control level to be indicated to the power supply circuit 1. The light control level determined by the first control circuit 20 is converted into the PWM signal (light control signal) by the signal output circuit 21, and the PWM signal is then output to the power supply circuit 1. The control circuit 13 of the power supply circuit 1 then adjusts outputs of the first and second step-down chopper circuits 12A and 12B in accordance with the light control level of the PWM signal received from the first controller 2. Accordingly, the light sources 4 emit light at the light control level indicated by the first controller 2.

The lighting control device A according to this embodiment may include the second controller 3, in addition to the power supply circuit 1 and the first controller 2. In other words, the second interface 33 of the second controller 3 may be electrically and mechanically connected to the first interface 26 of the first controller 2.

The second control circuit 30 clocks the accumulated lighting time of the light source 4 with the timer 36 installed in the microcontroller, and stores it in the memory 32. Further, the second control circuit 30 refers to the initial illuminance correction characteristic stored in the data table, and determines the light control level (control information) corresponding to the accumulated lighting time, periodically (e.g., every one minute). The second control circuit 30 transmits the determined light control level to the first control circuit 20 of the first controller 2 by serial communication. When receiving the light control level from the second control circuit 30 of the second controller 3, the first control circuit 20 replies an acknowledgement (ACK) signal to the second control circuit 30 by serial communication. The first control circuit 20 further reads the data table corresponding to the setting content of the setter 25, stored in the memory 22, and determines the light control level to be indicated to the power supply circuit 1, based on the light control level received from the second control circuit 30. The light control level determined by the first control circuit 20 is converted into the PWM signal by the signal output circuit 21, and the PWM signal is output to the power supply circuit 1. Then, the control circuit 13 of the power supply circuit 1 adjusts the outputs of the first and second step-down chopper circuits 12A and 12B in accordance with the light control level of the PWM signal received from the first controller 2. Therefore, the light sources 4 emit light at the light control level indicated by the first controller 2. Note that, when changing the light control level to a certain large level, the second control circuit 30 of the second controller 3 preferably changes the light control level gradually (stepwise) so as to fade in/fade out the light output (light flux) of the light sources 4.

The environment detector 31 of the second controller 3 may be a human sensor with a pyroelectric element. In this case, the second control circuit 30 preferably sets the light control level to 100 [%] while the environment detector 31 detects presence of a human and to 30 [%] while the environment detector 31 detects no presence of a human. When changing the light control level to 100 [%] or 30 [%], the second control circuit 30 may change the light control level gradually so as to fade in/fade out the light output (light flux) of the light sources 4.

The operation of the second controller 3 will be described in more detail. First, when the first controller 2 starts supplying of the operation voltage to the second controller 3, the second control circuit 30 sets the light control level to 100 [%] and indicates it to the first control circuit 20 such that the light control level is 100 [%] until the environment detector 31 is activated. Then, if the environment detector 31 detects no presence of a human until a fixed time elapses after the activation of the environment detector 31, the second control circuit 30 gradually reduces the light control level (100 [%]) to 30 [%]. When gradually changing the light control level from 100 [%] to 30 [%] or from 30 [%] to 100 [%], the second control circuit 30 may take a certain time (e.g., several seconds) to change the light control level so as not to give discomfort to a human. On the other hand, if the environment detector 31 detects presence of a human until the fixed time elapses, the second control circuit 30 keeps the light control level at 100 [%] and indicates it to the first control circuit 20.

When the environment detector 31 is an illuminance sensor, the second control circuit 30 performs feedback control for the light control level so as to match an illuminance (brightness) measured by the environ detector 31 with a target value, for example.

The lighting control device A according to this embodiment may include the third controller 3A, in addition to the power supply circuit 1, the first controller 2 and the second controller 3. In other words, the fourth interface 31A of the third controller 3A may be connected electrically and mechanically to the third interface 35 of the second controller 3. The third controller 3A communicates with a server of a maintenance company by radio communication using radio waves as a medium.

As already described above, the second control circuit 30 of the second controller 3 receives the abnormality sensing information relating to the power supply circuit 1 from the first control circuit 20, periodically (e.g., every ten minutes), and stores the received abnormality sensing information in the memory 32. When receiving a request from the server of the maintenance company through the third controller 3A, the second control circuit 30 outputs the latest abnormality sensing information stored in the memory 32 to the third controller 3A.

The third control circuit 30A of the third controller 3A generates the transmission frame including the latest abnormality sensing information received from the second controller 3. The generated transmission frame is subjected to the FSK modulation through the voltage control oscillator 34A. The modulated transmission frame (modulation signal) is amplified by the amplifier circuit 35A, and then radiated (transmitted) as radio waves from the antenna 36A. The radio signal transmitted from the antenna 36A is received by the server of the maintenance company.

The lighting control device A according to this embodiment may include the fourth controller 3B, in addition to the power supply circuit 1, the first controller 2 and the second controller 3. In other words, the fifth interface 31B of the fourth controller 3B may be connected electrically and mechanically to the third interface 35 of the second controller 3. The fourth controller 3B communicates with e.g., a wireless transceiver (remote controller) carried by a worker of the maintenance company by radio communication using infrared rays as a medium.

For example, the worker transmits a wireless signal (infrared signal) for requesting the abnormality sensing information, using the wireless transceiver. Regarding the fourth controller 3B, when the receiver 33B receives the wireless signal from the wireless transceiver, the fourth control circuit 30B requests the abnormality sensing information to the second control circuit 30 of the second controller 3. When receiving the request for the abnormality sensing information through the fourth controller 3B, the second control circuit 30 outputs the latest abnormality sensing information stored in the memory 32 to the fourth controller 3B.

The fourth control circuit 30B of the fourth controller 3B generates the transmission code including the latest abnormality sensing information received from the second controller 3, and outputs the generated transmission code to the transmitter 32B. The transmitter 32B transmits the transmission code received from the fourth control circuit 30B, as a wireless signal (infrared signal). The worker can get the latest abnormality sensing information by the wireless transceiver receiving the wireless signal from the transmitter 32B of the fourth controller 3B The wireless signal to be transmitted from the wireless transceiver is not limited to only a request for the abnormality sensing information. For example, the wireless transceiver may transmit the wireless signal, which includes the setting content set by the setter 25 of the first controller 2, to the fourth controller 3B. Regarding the fourth controller 3B, when the receiver 33B receives the wireless signal from the wireless transceiver, the fourth control circuit 30B transmits the setting content included in the wireless signal to the second control circuit 30 of the second controller 3. The second control circuit 30 transfers the setting content received from the fourth controller 3B to the first control circuit 20 of the first controller 2. The first control circuit 20 rewrites the setting content stored in the memory 22 with the setting content transferred from the second control circuit 30. In other words, the worker can update the setting content from ground, using the wireless transceiver, without climbing the lighting pole 8 to operate the se 25 of the first controller 2 housed in the luminaire body 70 of the luminaire C.

The third controller 3A or the fourth controller 3B for the radio communication may be formed integrally with the second controller 3. However, if the antenna 36A of the third controller 3A or a set of the transmitter 32B and the receiver 33B of the fourth controller 3B is housed in the luminaire body 70 made of metal, it may make extremely hard to perform the radio communication. For this reason, such a unit for the radio communication (the third controller 3A and the fourth controller 3B) is formed separately from the second controller 3, and further has a structure capable of being disposed outside the luminaire body 70.

As described above, the second controller 3; the second and third controllers 3 and 3A; or the second and fourth controllers 3 and 3B is appropriately added in the lighting control device A, the lighting apparatus B and the luminaire C according to this embodiment, and accordingly, it is possible to easily realize addition of a new function that cannot be realized by the basic configuration with only the power supply circuit 1 and the first controller 2. Even when the function to be realized by the second to fourth controllers 3, 3A or 3B is unnecessary, the second to fourth controllers 3, 3A and 3B can be easily removed. In other words, the lighting control device A, the lighting apparatus B and the luminaire C according to this embodiment can easily deal with extension of a function that needs additional hardware.

The power supply circuit 1 and the first controller 2 are basic constituent elements for the lighting control device A, the lighting apparatus B and the luminaire C. Accordingly, even when the performance of the light source 4 is improved in future, the p supply circuit 1 and the first controller 2 can be used without changing the circuit configuration thereof with high possibility. On the other hand, there is a case where a function such as initial illuminance correction, timer control or sensor control is added or removed as needed. Furthermore, a new function other than such the function needs additional hardware, separately, with high possibility. Accordingly, a controller different from the first controller 2 is prepared, and the first controller 2 is provided with an interface (first interface 26) such that the controller can be added to the first controller 2. Therefore, it is possible to reduce development cost and manufacturing cost of the lighting control device A, the lighting apparatus B and the luminaire C.

As apparent from the embodiment described above, a lighting control device (A), for controlling a light source (4), of a first aspect according to the present disclosure includes: a power supply circuit (1) configured to perform power conversion with power received from an external power source (6), and supply converted power as output power to the light source (4); and a first controller (2) configured to control the power supply circuit (1) to adjust the output power to be supplied to the light source (4). The first controller (2) includes a first control circuit (20), a signal output circuit (21) and a first interface (26). The first control circuit (20) is configured to allow the signal output circuit (21) to output a light control signal to the power supply circuit (1). The signal output circuit (21) is configured to output the light control signal for indicating magnitude of the output power to the power supply circuit (1). The first control circuit (20) is configured to transmit control information to and receive the control information from a second controller (3) through the first interface (26). When the control information is received from the second controller (3) through the first interface (26), the first control circuit (20) is configured to allow the signal output circuit (21) to output the light control signal corresponding to the control information to the power supply circuit (1).

With the lighting control device (A) of the first aspect configured as above, it is possible to easily deal with extension of a function that needs additional hardware, by connecting the second controller (3) to the first interface (26) of the first controller (2).

A lighting control device (A) of a second aspect according to the present disclosure, in the first aspect, preferably further includes the second controller (3) including a second interface (33). The second controller (3) preferably includes an environment detector (31) configured to detect an ambient environment. The second controller (3) preferably further includes a second control circuit (30) configured to generate the control information based on a detection result of the environment detector (31), and transmit the control information generated to the first interface (26) via the second interface (33).

With the lighting control device (A) of the second aspect configured as above, it is possible to control the light source (4) in accordance with the ambient environment, such as presence of a human or brightness.

A lighting control device (A) of a third aspect according to the present disclosure, in the first aspect, preferably further includes the second controller (3) including a second interface (33). The second controller (3) preferably includes a timer (36) for counting a time. The second controller (3) preferably further includes a second control circuit (30) configured to generate the control information based on the time (e.g., accumulated lighting time) counted by the timer (36), and transmit the control information generated to the first interface (26) via the second interface (33).

With the lighting control device (A) of the third aspect configured as above, it is possible to perform timer control to the light source (4).

Regarding a lighting control device (A) of a fourth aspect according to the present disclosure, in any one of the first to third aspects, the first interface (26) preferably includes a first connector. The first connector is preferably to be detachably connected electrically and mechanically to a second connector of the second controller (3). Note that, the first connector is preferably any one of two types of receptacle connectors (50, 52), or any one of two types of plug connectors (51, 53). Also, the second connector is preferably any one of two types of plug connectors (51, 53), which can be connected to the first connector, or be one of two types of receptacle connectors (50, 52), which can be connected to the first connector.

With the lighting control device (A) of the fourth aspect configured as above, it is possible to improve workability relating to working, such as adding or removing of the second controller (3).

Regarding a lighting control device (A) of a fifth aspect according to the present disclosure, in any one of the first to fourth aspects, the power supply circuit (1) preferably includes: a power conversion circuit (first step-down chopper circuit (12A) and second step-down chopper circuit (12B)); and a control circuit (13) configured to control the power conversion circuit in accordance with the light control signal. The power supply circuit (1) preferably further includes an operation power supply circuit (18) configured to generate operation power for operating the power conversion circuit and the control circuit (13). The first control circuit (20) of the first controller (2) is preferably configured to operate with the operation power.

With the lighting control device (A) of the fifth aspect configured as above, the first controller (2) is not needed to have therein a power supply circuit for operation power. Therefore, it is possible to simplify the circuit configuration of the first controller (2).

Regarding a lighting control device (A) of a sixth aspect according to the present disclosure, in the fifth aspect, the first controller (2) is preferably configured to supply the operation power to the second controller (3) through the first interface (26). The second controller (3) is preferably configured to operate with the operation power.

With the lighting control device (A) of the sixth aspect configured as above, the second controller (3) is not needed to have therein a power supply circuit for operation power. Therefore, it is possible to simplify the circuit configuration of the second controller (3).

A lighting apparatus (B) of a seventh aspect according to the present disclosure includes: the lighting control device (A) of any one of the first to sixth aspects; and the light source (4) that receives the output power of the lighting control device (A) to emit light.

A luminaire (C) of an eighth aspect according to the present disclosure includes: the lighting apparatus (B) of the seventh aspect; and a luminaire body (70) that supports the lighting apparatus (B).

With the lighting apparatus (B) of the seventh aspect and the luminaire (C) of the eighth aspect configured as above, it is possible to easily deal with extension of a function that needs additional hardware.

A lighting control device (A) of a ninth aspect according to the present disclosure, in the first aspect, preferably further includes the second controller (3). In this case, the second controller (3) preferably includes: a second interface (33) to which the first interface (26) is to be electrically and mechanically coupled; and a third interface (35) to which an additional controller is to be electrically and mechanically coupled.

A lighting control device (A) of a tenth aspect according to the present disclosure, in the ninth aspect, preferably further includes a third controller (3A). In this case, the third controller (3A) preferably includes a fourth interface (31A) to which the third interface (35) is to be electrically and mechanically coupled, and is configured to perform radio communication, using radio waves as a medium.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

The invention claimed is:

1. A lighting control device for controlling a light source, comprising:

a power supply circuit configured to perform power conversion with power received from an external power source, and supply converted power as output power to the light source; and a first controller configured to control the power supply circuit to adjust the output power to be supplied to the light source, wherein:

the first controller includes a first control circuit, a signal output circuit and a first interface, the first control circuit is configured to allow the signal output circuit to output a light control signal to the power supply circuit, the signal output circuit is configured to output the light control signal for indicating magnitude of the output power to the power supply circuit, the first control circuit is configured to transmit control information to and receive control information from a second controller through the first interface, and when the control information is received from the second controller through the first interface, the first control circuit is configured to allow the signal output circuit to output the light control signal corresponding to the control information to the power supply circuit.

2. The lighting control device according to claim 1, further comprising the second controller including a second interface, wherein the second controller further comprises:

an environment detector configured to detect an ambient environment; and a second control circuit configured to generate the control information based on a detection result of the environment detector, and transmit the control information generated to the first interface via the second interface.

3. The lighting control device according to claim 1, further comprising the second controller including a second interface, wherein the second controller further comprises:

a timer for counting a time; and a second control circuit configured to generate the control information based on the time counted by the timer, and transmit the control information generated to the first interface via the second interface.

4. The lighting control device according to claim 1, wherein the first interface comprises a first connector to be detachably connected electrically and mechanically to a second connector of the second controller.

5. The lighting control device according to claim 1, wherein:

the power supply circuit comprises:

a power conversion circuit;

a control circuit configured to control the power conversion circuit in accordance with the light control signal; and an operation power supply circuit configured to generate operation power for operating the power conversion circuit and the control circuit, and the first control circuit of the first controller is configured to operate with the operation power.

6. The lighting control device according to claim 5, wherein:

the first controller is configured to supply the operation power to the second controller through the first interface, and the second controller is configured to operate with the operation power.

7. A lighting apparatus, comprising:

the lighting control device according to claim 1; and the light source that receives the output power of the lighting control device to emit light.

8. A luminaire, comprising:

the lighting apparatus according to claim 7; and a luminaire body that supports the lighting apparatus.

* * * * *